US005775886A

United States Patent [19]

Terwilliger

[11] Patent Number: 5,775,886

[45] Date of Patent: Jul. 7, 1998

[54] GAS COMPRESSOR WITH RECIPROCATING PISTON WITH VALVE SHEATH

[76] Inventor: Gerald L. Terwilliger, 4122 Pine Creek, Tyler, Tex. 75707

[21] Appl. No.: 700,322

[22] Filed: Aug. 8, 1996

[51] Int. Cl.[6] ..... F04B 21/04

[52] U.S. Cl. ..... 417/553; 417/545; 417/552; 417/541; 92/81; 92/82; 137/514

[58] Field of Search ..... 417/545, 550, 417/552, 553, 541, 542; 92/181 R, 81, 82; 137/514, 514.5, 543.23, 540

[56] References Cited

U.S. PATENT DOCUMENTS

| | | | |
|---|---|---|---|
| 1,583,535 | 5/1926 | Dubrovin | 417/570 |
| 2,033,437 | 3/1936 | McCune et al. . | |
| 2,327,269 | 8/1943 | Jessup | 417/570 |
| 2,436,854 | 3/1948 | Corey . | |
| 2,863,301 | 12/1958 | Philipp . | |
| 2,970,608 | 2/1961 | Doeg | 417/569 |
| 3,071,921 | 1/1963 | Wild | 92/181 R |
| 3,177,893 | 4/1965 | King | 137/514 |
| 3,306,524 | 2/1967 | Matuki et al. . | |
| 3,490,683 | 1/1970 | Kocher . | |
| 3,509,907 | 5/1970 | Gannaway . | |
| 3,811,470 | 5/1974 | Schaefer | 137/540 |
| 3,915,597 | 10/1975 | Grant et al. . | |
| 4,329,125 | 5/1982 | Chambers | 417/569 |
| 4,353,682 | 10/1982 | Linnert et al. . | |
| 4,355,962 | 10/1982 | Magers | 417/552 |
| 4,537,566 | 8/1985 | Blass et al. . | |
| 4,570,666 | 2/1986 | Hartshorn | 137/514 |
| 4,930,999 | 6/1990 | Brunet et al. | 417/552 |
| 4,955,796 | 9/1990 | Terwilliger . | |
| 4,960,038 | 10/1990 | Klie et al. | 92/181 R |
| 5,080,130 | 1/1992 | Terwilliger et al. . | |
| 5,203,857 | 4/1993 | Terwilliger . | |

*Primary Examiner*—Timothy Thorpe
*Assistant Examiner*—Ted Kim
*Attorney, Agent, or Firm*—Luedeka, Neely & Graham, P.C.

[57] ABSTRACT

A highly manufacturable gas compressor includes a sheath removably attached to a piston by several resilient fingers that snap into place at the bottom of the piston. The fingers act to limit relative motion between the piston and sheath as the piston is reciprocated within a cylinder bore. During the suction stroke of the compressor, the piston and sheath separate at their tops, creating an opening at the top of the sheath which allows low pressure gas to flow through an opening formed in the side of the sheath, between the sheath and piston, through the opening at the top of the sheath, and into a compression chamber formed between the top surfaces of the piston and sheath and the bottom surface of a discharge valve. During the compression stroke, the tops of the piston and sheath combine to form a contiguous surface that compresses the low pressure gas in the compression chamber against the bottom surface of the discharge valve, forcing the discharge valve open to release pressurized gas into a discharge chamber. The valving sheath includes a lip seal to prevent pressurized gas from escaping the compression chamber between the sheath and cylinder bore wall. Slugging protection means are provided by the discharge valve and the sheath. To eliminate noise and increase efficiency, the sheath and discharge valve are formed from a thermoplastic material.

53 Claims, 10 Drawing Sheets

GAS COMPRESSOR WITH RECIPROCATING PISTON WITH VALVE SHEATH

TECHNICAL FIELD

The present invention relates generally to a device for compressing a gas, and particularly to a refrigerant compressor for use in a closed loop refrigeration system.

BACKGROUND

Gas compressors are employed in many types of mechanical systems to achieve various tasks. For example, air compressors are currently used in such applications as filling scuba dive tanks with breathable air, pressurizing automobile tires, and providing a source of power for pneumatically-powered tools such as jackhammers and air wrenches. Another popular type of gas compressor is the kind used in closed-loop air conditioning, refrigeration, and heating systems. Such systems typically employ a compressible gas which is thermodynamically cycled to provide cooling or heating to a defined area.

In each application, it is desirable to employ a gas compressor that compresses gas as efficiently and quietly as possible. Efficiency is typically affected by many factors, including compressor weight, friction, inertia, and amount of gas re-expansion at the apex of the compression stroke. Noise within a compressor generally results when one or more moving parts make contact with another part. Unfortunately, in compressor designs low noise and high efficiency are often contrasting design parameters in that one is usually obtained at the expense of the other. It is desirable, therefore, to provide a novel gas compressor that both improves operation efficiency and reduces noise.

As the refrigerant compressor industry transitions from the use of hydroflourocarbon (HFC) refrigerants to more environmentally friendly (EF) refrigerants, such as R134A, gas compressors must be designed and manufactured for operation with the new refrigerants. In general, the new EF refrigerants require compression at higher pressures to achieve the same thermodynamic effects realized by their HFC predecessors. Thus, gas compressors that employ EF refrigerants must be hardy enough to operate at the higher pressures required while at the same time providing as much capacity, efficiency, and quietness as possible.

Manufacturability is another highly important consideration in gas compressor designs. Many gas compressors employ designs having complex geometries requiring the manufacture and assembly of several parts to achieve the functional objective. These complex geometries are typically difficult and costly to manufacture. Correspondingly, as assembly elements and complexity goes up, manufacturability of the combined machine goes down.

An example of a prior art compressor should help illustrate some of the problems that are yet unresolved. In U.S. Pat. Nos. 5,203,857, 5,080,130, and 4,955,796 to Terwilliger, a refrigerant compressor incorporates a free-floating valve disc for controlling the flow of low pressure gas into the compression area. During the suction stroke of the piston, low pressure gas enters the compression chamber by flowing around the circular periphery of the valve disc. The valve disc includes an annular attachment flange for retaining the valve disc to the top of the piston. A flat, circular retainer plate attached to the top of the piston secures the valve disc by engagement of the annular flange. The periphery of the retainer plate is adapted to abut the bore wall of the valve disc to prevent radial displacement of the disc. A circular access cover is provided in the top of the valve disc to complete the planar upper surface of the disc. A separate flip seal is provided in the outer wall of the piston to provide a compression seal between the piston and bore wall. This geometrically complex design requires that the piston and valve disc assembly be manufactured and assembled with at least five separate parts: (1) a piston; (2) a valve disc; (3) a circular retainer plate; (4) a circular access cover; and (5) a flip seal.

Noise is another undesirable effect of many prior art compressors. The free-floating valve disc of the Terwilliger compressor, having no means for damping relative contact between the piston and disc, produces noise each time the piston transitions from suction stroke to compression stroke, and vice versa, as the circular retainer plate contacts the annular attachment flange, circular access cover, and valve disc bore wall.

Each of the Terwilliger references require a discharge porting plate sandwiched between the cylinder head and block for regulating the output of gas from the compression chamber. A discharge valve disc is positioned within the discharge chamber between the head and porting plate. The discharge valve disc is urged toward the porting plate by a spring so that during the suction stroke, the discharge valve disc is seated against the porting plate and during compression, it is raised to release pressured gas that flows between the porting plate and discharge valve disc into the discharge chamber. A single stanchion positioned central to the discharge valve disc guides the discharge valve disc during its reciprocal valving motion. As the discharge valve disc reciprocates along the stanchion, the disc will tend to wobble due to uneven distribution of forces acting upon the disc. This phenomenon presents the Terwilliger compressor with another source of noise during operation.

In one embodiment of the Terwilliger patents, the valve disc is disclosed as a single molded piece having a plurality of fingers circumferentially spaced around the lower side. The fingers include beveled leading edges for camming over the periphery of the annular attachment flange. However, Terwilliger does not disclose means for preventing inadvertent release of the pliable fingers from the attachment flange. Thus, an inherent, and yet unresolved, failure mode is presented by the Terwilliger valve disc.

What is needed, therefore, is a novel gas compressor that maximizes capacity and efficiency while minimizing cost and noise. The compressor should be highly manufacturable and capable of withstanding the higher operating pressures required for EF refrigerants. Finally, any low pressure gas valving means attached to the piston should be attached in such as way as to essentially eliminate the possibility of compressor failure resulting from separation of the valving means from the piston.

SUMMARY

In accordance with a preferred embodiment of the invention, a gas compressor includes a piston mounted for reciprocation within a cylinder block bore. The piston includes a piston top, a piston bottom, a piston perimeter, and a piston length defined by the distance between the top and bottom. A valving sheath is positioned around the piston so that the top of the sheath is adjacent the piston top and the body of the sheath is positioned intermediate the piston and bore wall. During the suction stroke, an opening formed in the top of the sheath allows low pressure gas to flow from an inlet formed in the cylinder block and into a compression chamber formed between the piston and sheath tops and the bottom surface of a discharge valve that is mounted intermediate the sheath top and a cylinder block head. Low pressure gas reaches the compression chamber by flowing through an opening formed in the side of the sheath, through a sheath chamber formed between the piston and sheath, and then through the opening at the top of the sheath and into the compression chamber. The inlet is in fluid communication with the sheath chamber to enable low pressure gas to enter the compression chamber during the suction stroke. The top of the discharge valve and the cylinder block head define a discharge chamber therebetween into which pressurized gas is received from the compression chamber during the compression stroke. Also provided are means for sealing the compression chamber to prevent compressed gas from escaping the compression chamber, and means for isolating the discharge chamber from the compression chamber during at least a portion of the suction stroke of the piston.

The sheath, which may be fabricated from a thermoplastic material, is retained to the piston by means of one or more resilient fingers formed in the sheath bottom. The fingers function to retain the sheath to the piston when the piston and sheath are positioned in the piston bore. The fingers also function to limit relative movement between the sheath and piston to less than the piston stroke distance. When the sheath and piston are removed from the piston bore, the fingers can be moved to enable separation of the sheath from piston.

To minimize impacting between the sheath and piston, means are provided for damping relative motion between the sheath and piston, at least during startup of the compressor.

In another preferred embodiment, a compressor discharge valve assembly is disposed between the cylinder block and cylinder block head of a gas compressor to regulate the release of compressed gas from a compression chamber disposed in a piston bore formed in the cylinder block to a discharge chamber formed in the cylinder block head. In this embodiment, a seating surface is formed in the cylinder block adjacent the piston bore. A discharge valve, which may be of lenticular shape and formed from a thermoplastic material, is mounted intermediate the cylinder block head and the compression chamber and movably connected to the cylinder block. The discharge valve includes a bottom surface adjacent the compression chamber, a top surface adjacent the discharge chamber, and a discharge valve seat conforming to the seating surface. Means, such as a helical coil spring, are provided for resiliently urging the discharge valve toward the piston bore so that the discharge valve seat engages the seating surface when the force applied to the bottom of the discharge valve by compressed gas in the compression chamber is less than the force being applied by the helical coil spring.

The discharge valve may be movably connected to the cylinder block by a plurality of stanchions disposed in stanchion bores within the cylinder block. At least a portion of each stanchion protrudes from the cylinder block by a stanchion protrusion length. A plurality of guides are provided on the top surface of the discharge valve. Each of the guides includes means for securing the discharge valve to a stanchion so that the discharge valve maintains proper alignment with the seating surface formed in the cylinder block.

To prevent misalignment of the discharge valve during operation, a protruding member is formed in the top of the discharge valve and positioned at a limit distance from the cylinder block head when the discharge valve is closed and in contact with the cylinder block. The protrusion length of each stanchion is greater than this limit distance so that if the discharge valve travels the entire limit distance, the protruding member makes contact with the cylinder block head and is unable to travel further. At the point where the protruding member and cylinder block head make contact, the discharge valve guides remain secured to the stanchions, thus preventing misalignment of the discharge valve.

Slugging protection may be provided at one or more of the stanchions. A slugging bore formed in the cylinder block in axial alignment with a stanchion bore provides containment of fluids that might form within the compressor. A slugging member extending from the guide into the slugging bore limits movement of the discharge valve when fluids are present in the slugging bore.

Also provided by the present invention is a compressor valving sheath assembly disposed between the piston and piston bore wall of a gas compressor. The sheath assembly, which functions to regulate the input of gas from a gas passage to a compression chamber within the compressor, includes a valving sheath having a sheath top disposed over the top of the piston, a sheath body positioned intermediate the piston and bore wall, an outer surface defining an outer perimeter, and an inner surface defining an inner perimeter greater than the perimeter of the piston but less than the outer sheath perimeter. The inner surface also includes a sheath seat for engaging the piston top. Openings formed in the sheath include a top opening formed in the sheath top, and at least one body opening formed in the sheath body. The sheath and piston are positioned in the piston bore so that the inner sheath perimeter is adjacent the piston perimeter and the outer sheath perimeter is adjacent the bore wall. A sheath chamber is defined by the area between the inner sheath perimeter and the piston perimeter. Means for sealing, such as a lip seal formed in the outer surface of the sheath, is provided to seal the outer surface of the sheath against the bore wall to prevent compressed gas in the compression chamber from escaping along the bore wall. Finally, an inlet in communication with the sheath chamber allows gas to enter the compression chamber by way of the sheath chamber during at least a portion of the suction stroke of the piston.

The sheath may be retained by the piston by including one or more resilient fingers at the bottom of the sheath. The fingers, which include an engagement surface for engaging the piston bottom, function to limit relative movement between the sheath and piston to less than the piston stroke distance. When the piston and sheath are removed from the piston bore, the resilient fingers may be moved to allow separation of the piston and sheath.

BRIEF DESCRIPTION OF THE DRAWINGS

The preferred embodiments of the invention will now be described in further detail with reference to the drawings wherein like reference characters designate like or similar elements throughout the several drawings as follows.

DETAILED DESCRIPTION OF PREFERRED EMBODIMENTS

Figure 1:
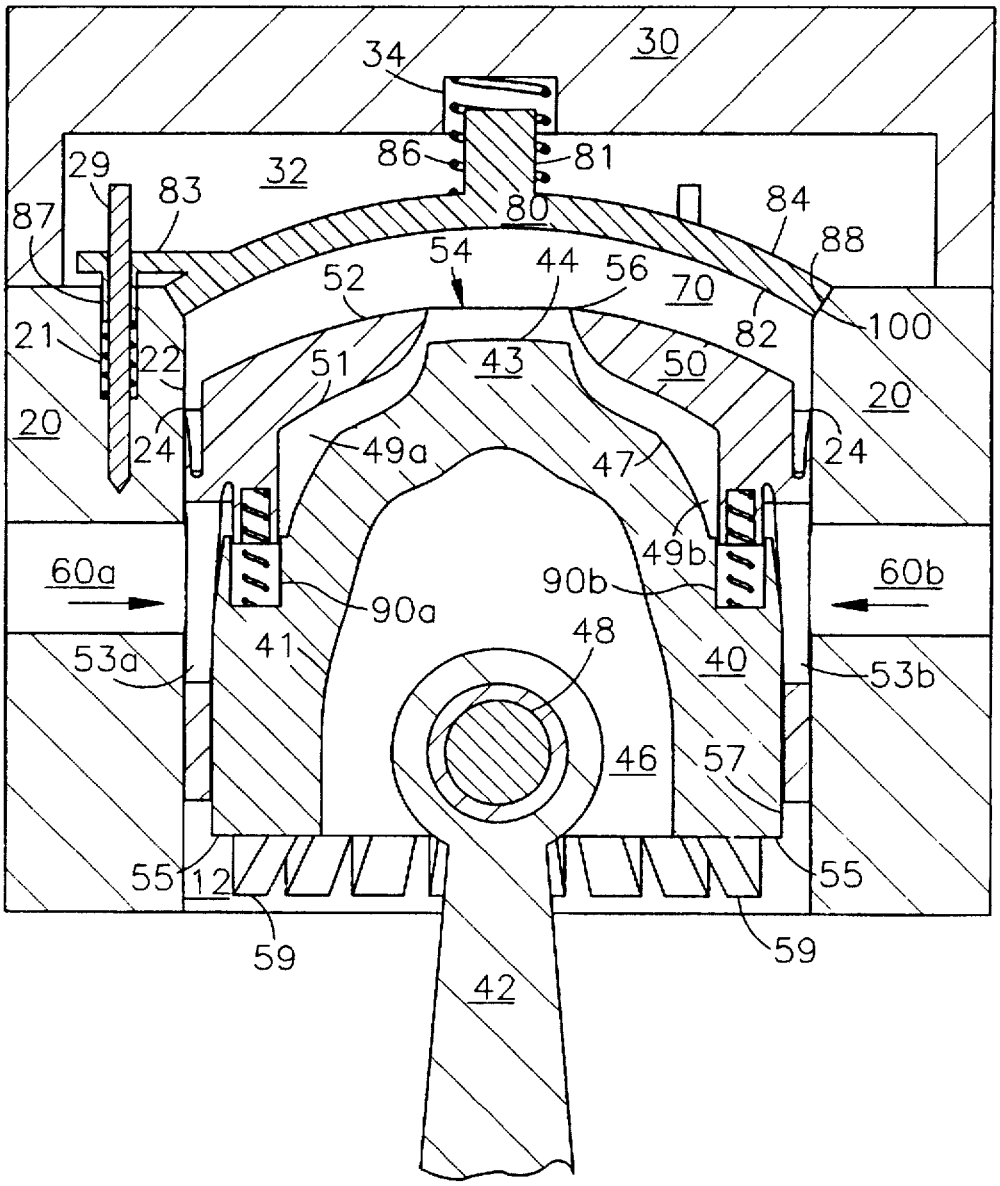
FIG. 1 is a cross-section view of a gas compressor in accordance with the present invention as it appears during the compression stroke of the compressor.
Figure 2:
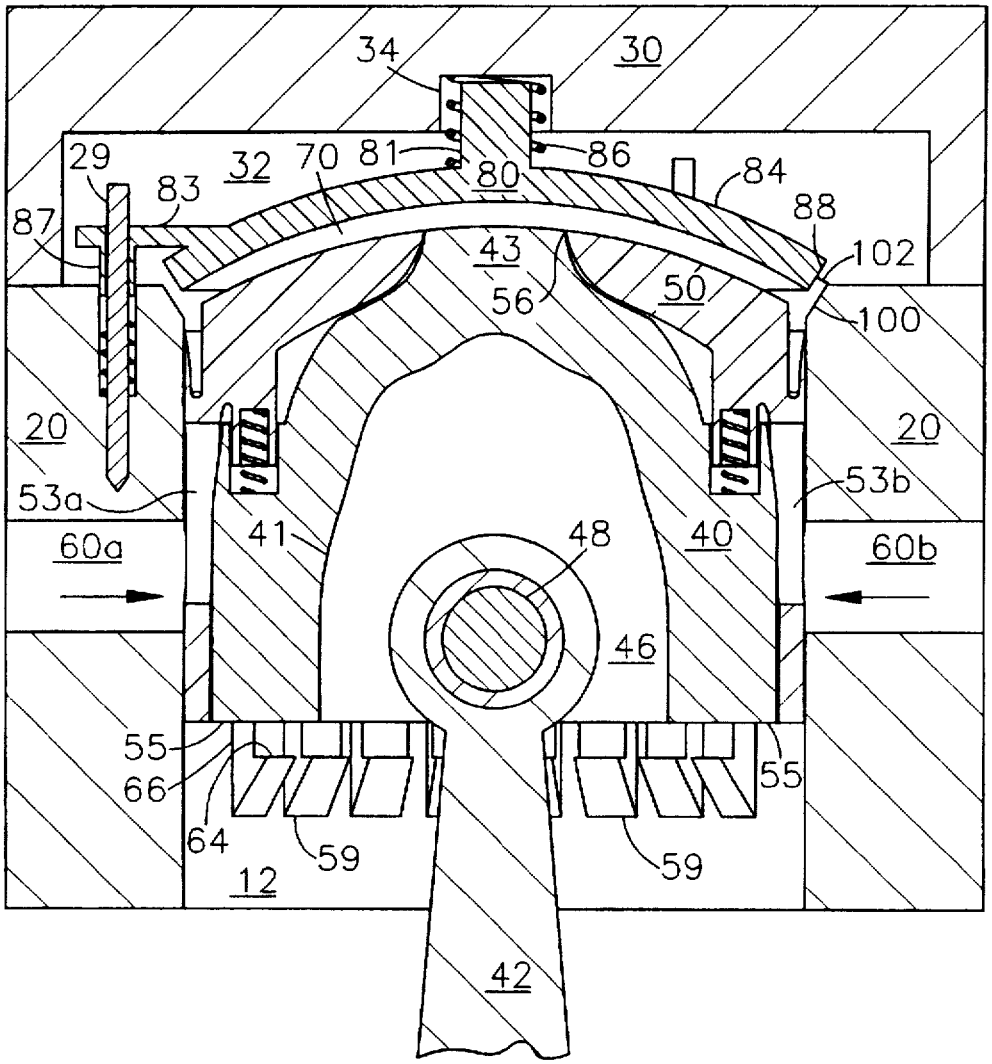
FIG. 2 is a cross-section view of the gas compressor of FIG. 1 during the suction stroke of the compressor.
Figure 3:
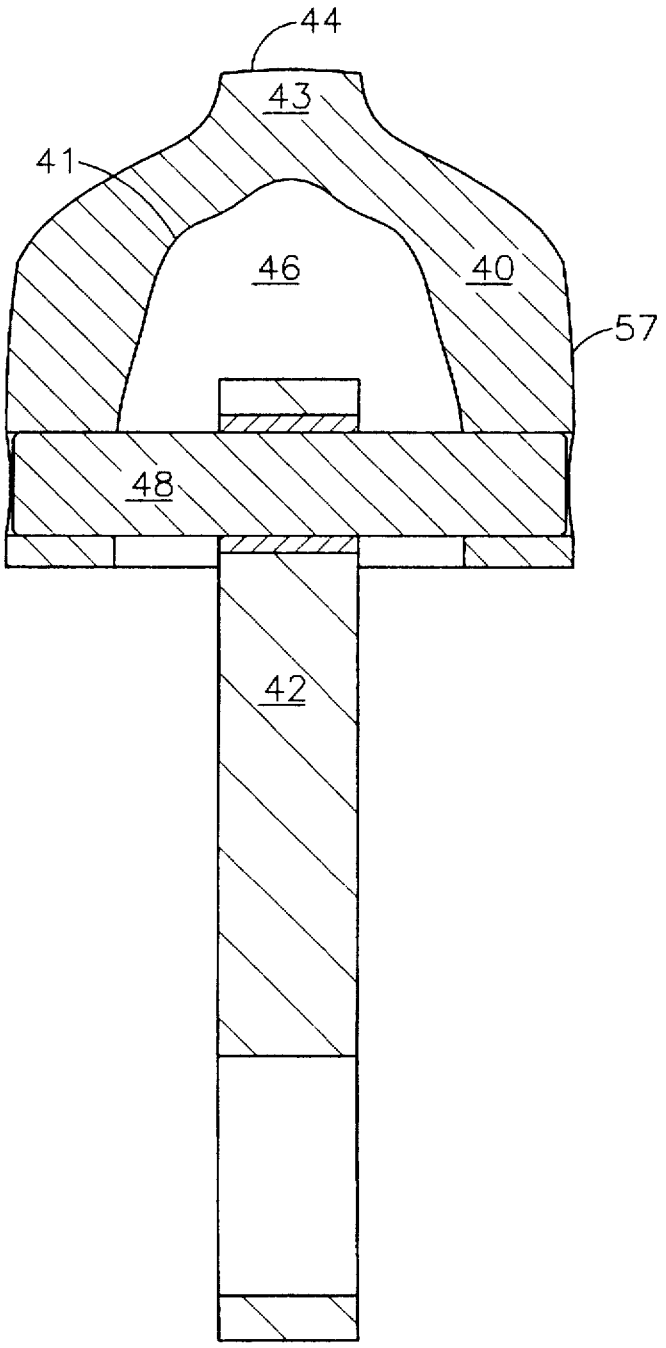
FIG. 3 is a cross-section view a compressor piston connected to a con rod by means of a wrist pin.

In accordance with a preferred embodiment of the present invention, a gas compressor 10 for compressing a refrigerant gas in a refrigeration system, for example, is illustrated in the cross-sectional views of FIGS. 1 and 2. FIG. 1 illustrates the relative positions of parts during the suction stroke, and FIG. 2 illustrates the compressor 10 during the compression stroke. The compressor 10 includes a cylinder block 20 having a bore 12 formed therein and a cylinder head 30 in gasketed compression with the block 20, forming a discharge chamber 32 between the block 20 and head 30. A generally cylindrical piston 40 having a wrist pin cavity 46 and an outer perimeter indicated generally at 57 is mounted for reciprocation within the bore 12 by means of a con (connecting) rod 42 interconnecting the piston 40 and crank shaft (not shown). The con rod 42 is pivotally connected to the piston 40 within the wrist pin cavity 46 by a wrist pin 48 that is inserted through and supported by the piston 40, as shown in greater detail in FIG. 3.

A valving sheath 50 is positioned around the outer perimeter 57 of the piston 40 as shown in FIGS. 1 and 2 to regulate the flow of low pressure gas from low pressure gas passages 60*a*, 60*b* formed in the block 20 into a compression chamber 70 defined by the area between the upper surface 44 of piston protrusion 43, the top surface 52 of the valving sheath 50, and the lower surface 82 of discharge valve 80. The valving sheath 50 is preferably fabricated from a thermoplastic material capable of withstanding the full range of operating temperatures and pressures to be expected for the particular compressor application. For most refrigeration system applications, temperatures as high as 350° F. and pressures as high as 3500 psi can typically be expected, especially for applications that employ so-called "environmentally friendly" refrigerants. Such thermoplastic materials as Kadel™ manufactured by Amoco, or Vespel™ manufactured by DuPont, have been found to be particularly suitable for most refrigerant system applications, providing the necessary structural integrity and flexibility as well as reduced noise and weight. However, it will be understood that the type of material used in construction of the valving sheath 50 will depend upon the particular demands imposed by the compressor system. For more demanding applications, a thicker and/or more hearty material may be used. Likewise, materials exhibiting less resistance to heat, force, and pressure may be used in less demanding applications.

Referring now to FIGS. 1, 2, 5, and 6, the piston 40 includes an upper, preferably circular protrusion 43 centrally located to the piston's axis of reciprocation and forming an upper surface 44. A circular opening 54 through the top surface 52 of the valving sheath 50 is positioned and sized to receive the piston protrusion 43 during the compression stroke, forming a circumferential, conformal seal 56 between the piston's inner surface 47 and the sheath's inner surface 51, thus preventing gas within the compression chamber 70 from re-entering passages 60*a*, 60*b*. Two oppositely oriented channels 45*a*, 45*b* (FIGS. 5 and 6) are formed in the outer surface 47 of the piston 40 as shown to help channel low pressure gas through low pressure chambers 49*a*, 49*b* created between the piston's outer surface 47 and the sheath's inner surface 51. The remaining portion of the piston's outer surface 47, including outer perimeter 57, is preferably shaped to conform to the inner surface 51 of the sheath 50. To improve manufacturability, the thickness of the piston 40 (i.e., the distance between the piston's inner surface 41 and outer surface 47 and perimeter 57) is preferably maintained as uniformly as possible throughout the piston 40. Low pressure chambers 49*a*, 49*b* are aligned with the positions of passages 60*a*, 60*b* to enable low pressure gas to flow readily out of passages 60*a*, 60*b* during the suction stroke (FIG. 2), through low pressure chambers 49*a*, 49*b*, and into the compression chamber 70.

Figure 7:
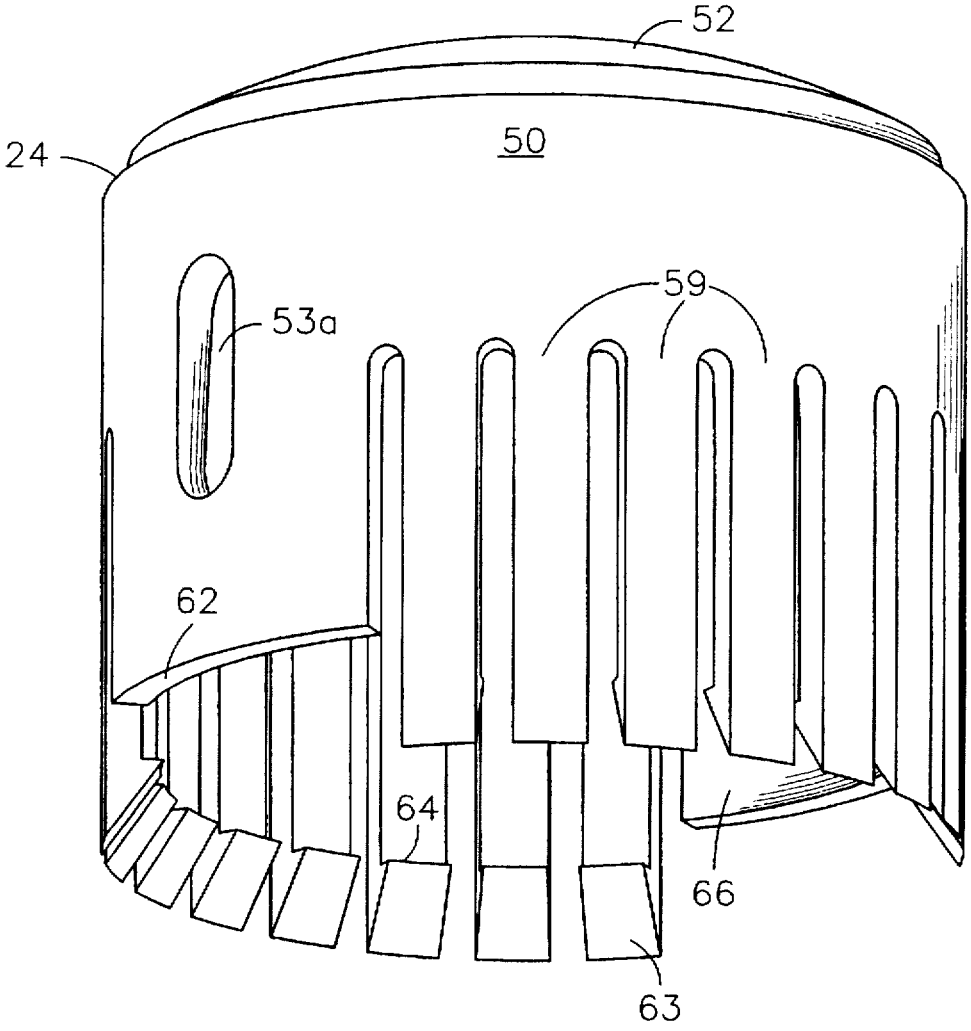
FIG. 7 is an isometric view of the valving sheath of FIG. 5.

As seen in the isometric illustration of FIG. 7, the valving sheath 50 includes a plurality of resilient fingers 59 formed in the wall of the sheath 50 and extending below the sheath bottom 62. Each of the fingers 59 includes a beveled surface 63 for caming over the outer perimeter 57 of the piston 40 as the piston 40 is inserted in the sheath 50. A lip area 64 on each of the fingers 59 extends beyond the inner wall 66 of the sheath 50 to contact the bottom 55 of the piston 50 during relative motion of the piston 40 and sheath 50, thus preventing the sheath 50 and piston 40 from separating as the piston 40 is reciprocated by the con rod 42. The lip area 64 on each of the fingers 59 also function to limit relative movement between the sheath 50 and piston 40 to less than the piston stroke distance.

Figure 8:
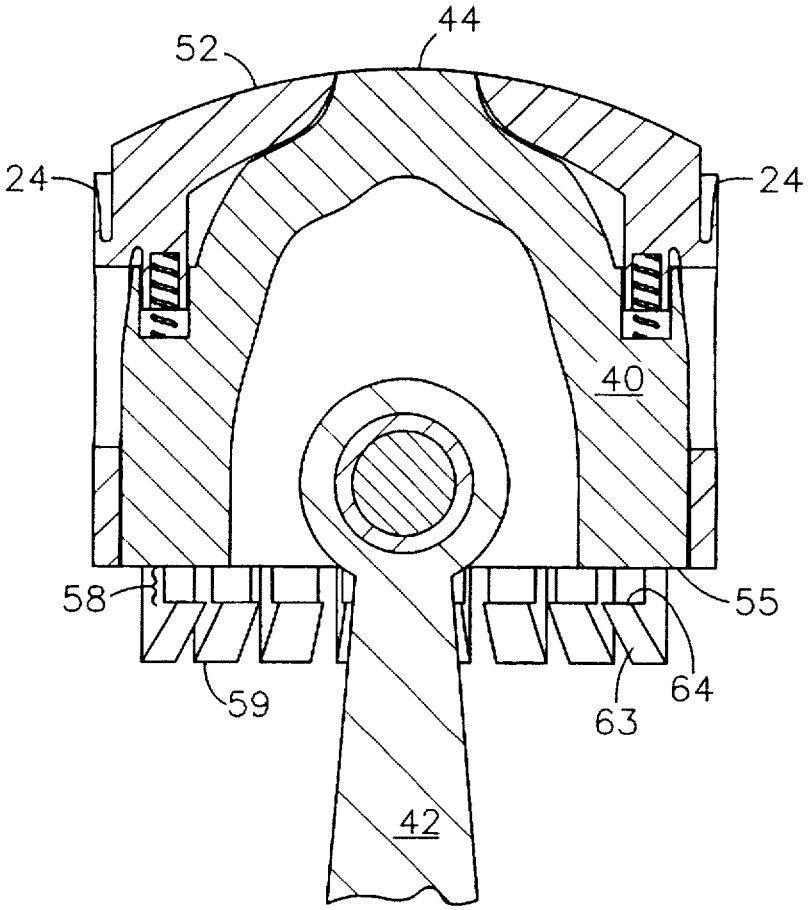
FIG. 8 is a cross-section view of the piston and sheath.

As FIG. 8 illustrates, relative motion between the sheath 50 and piston 40 is limited to the distance 58 between the piston bottom 55 and lip area 64 when the sheath's top surface 52 is aligned with the protruding upper surface 44 of the piston 40. Since the piston's upper surface 44 and the sheath's top surface 52 are flush with each other in FIG. 8, as occurs during the compression stroke, the distance 58 in FIG. 8 illustrates a maximum distance between the piston bottom 55 and lip area 64. This maximum distance can be changed by adjusting either the length of the piston 40 or the length of the sheath 50, or both.

As previously discussed, the sheath 50 is preferably fabricated from a thermoplastic material, which provides the advantage of reducing noise resulting from contact between the piston 40 and sheath 50 and for reducing the overall weight of the sheath 50. To further reduce noise, optional dampers 90*a*, 90*b* may be formed between the piston 40 and sheath 50 to reduce the force of impact when the piston protrusion 43 contacts the sheath 50 at the seal 56, as well as any other piston-to-sheath contact that might occur during the compression stroke, and when the piston bottom 55 contacts the lip areas 64 of the fingers 59 as may occur during the suction stroke.

Figure 9:
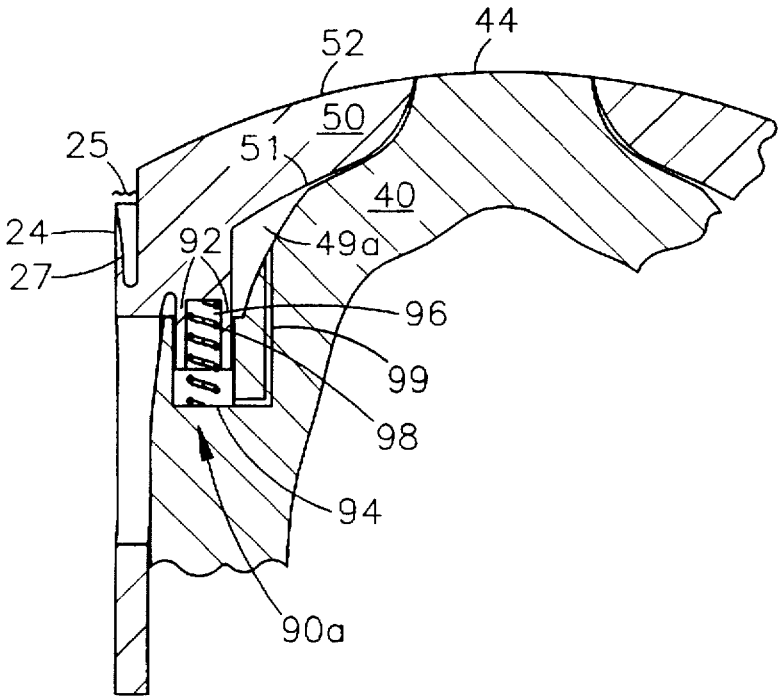
FIG. 9 is a sectional view of the piston and sheath, illustrating dampers formed in the piston and sheath which function to dampen contact between the piston and sheath as the piston is reciprocated.

As FIGS. 1, 2, and 9 illustrate, each of the dampers 90*a*, 90*b* include a stanchion 92 formed at the inner surface 51 of sheath 50 and a stanchion bore 94 formed at the outer surface 47 of the piston 40 and sized to receive the stanchion 92. The stanchion 92 includes a spring pocket 96 into which a spring 98 is positioned as shown. The spring 98 is biased to force the piston 40 and sheath 50 away from each other. When the piston 40 is reciprocated by the con rod 42, inertial forces acting on the sheath 50 enable the sheath 50 and piston 40 to overcome the opposing force created by the spring 98 and establish contact to create seal 56 during the compression stroke. However, because of the force created by spring 98, which acts to oppose contact between the piston 40 and sheath 50, the intensity of contact between the piston 40 and sheath 50 is greatly reduced. In this manner, the spring 98 acts to dampen piston-to-sheath contact and reduce noise during reciprocation.

Another function of the dampers 90*a*, 90*b* is slugging protection. Slugging occurs when liquid is present within the compressor 10, as can occur when the refrigerant gas condenses. Unlike gases, liquids are incompressible and can place intolerable stresses on the piston 40 and/or sheath 50, possibly resulting in compressor failure. To reduce the adverse effects of slugging, the two dampers 90*a*, 90*b* are oppositely oriented to each other with each lying in a plane normal to the earth's gravitational pull. Such positioning of the dampers 90*a*, 90*b* allows liquid within the bore 12 to evenly fill the stanchion bores 94 of both dampers 90*a*, 90*b* as opposed to filling only one damper which could result in an undesirable condition where uneven, nonsysmmetrical slugging forces are applied to the piston 40 and sheath 50. When liquid is present in the stanchion bore 94, the stanchion 92 is restricted in its reciprocal movement within the bore 94. When a sufficient amount of liquid is present in the bore 94, the dampers 90*a*, 90*b* prevent the sheath 50 and piston 40 from making contact at seal 56. During this mode of operation, low pressure gas received from passages 60*a*, 60*b* is allowed to backflow into passages 60*a*, 60*b* and/or enter discharge chamber 32 so that the gas is not fully compressed, thus reducing the forces otherwise acting upon the piston 50 and sheath 40 and preventing possible failure. As the liquid evaporates or is otherwise removed, full range of motion is restored to the dampers 90*a*, 90*b* and the compressor 10 is again able to fully compress gas within the compression chamber 70.

With continued reference to FIG. 9, the relative diameters of stanchion 92 and bore 94 can be varied to control the damping effect. For example, when the diameter of stanchion 92 is substantially smaller than the diameter of bore 94, liquid is allowed to escape from the bore 94 by flowing around stanchion 92 and into the low pressure chamber 49*a* at a high rate during compression, thus lessening the damping effect. As the stanchion diameter is increased relative to the bore diameter, the flow of liquid from bore 94 into the low pressure chamber 49*a* is more restricted and a greater amount of damping is provided. The amount of damping can also be regulated by forming a slugging channel 99 in the piston 40. Additionally, the size of channel 99 can be varied to regulate the amount of liquid flowing from the bore 94 into chamber 49*a*.

For many refrigeration systems, the orientations of the compressor 10 and passages 60*a*, 60*b* are such that the cross-sectional illustrations of FIGS. 1 and 2 represent a plane that is normal to the earth's gravitational pull. Thus, a preferred embodiment of the invention positions the dampers 90*a*, 90*b* within the low pressure chambers 49*a*, 49*b* as shown. Alternatively, the dampers may be located at other positions. When positioning the dampers 90*a*, 90*b* within the low pressure chambers 49*a*, 49*b*, care must be taken to ensure sufficient space is provided to allow low pressure gas to flow around the dampers 90*a*, 90*b*.

When removed from the bore 12, the sheath 50 and piston 40 can be separated by forcing the lip areas 64 on each of the fingers 59 outwardly beyond the piston's outer perimeter 57. However, once the sheath 50 is snapped in place over the piston 40 and the resulting combination inserted into the bore 12, the fingers 59 are constrained by the bore wall, and the piston 40 and sheath 50 become inseparable. Thus, another function of the fingers 59 is to eliminate failure modes associated with separation of the piston 40 and sheath 50 during compressor operation.

The sheath 50 and piston 40 combination greatly simplifies manufacture of the compressor 10, resulting in significant production cost savings over presently existing compressors. Manufacturing is simplified in a number of ways. For example, because of the geometries involved, the sheath 50 and piston 40 can each be easily manufactured according to conventional die cast methods. The geometries of both the piston 40 and sheath 50 enable easy pull, or removal of the die from the part. Because the piston 40 and sheath 50 can each be manufactured as a single part, there are less parts to manufacture and assemble. The sheath 50 also covers and protects both ends of the wrist pin 48 which prevents the wrist pin 48 from inadvertently sliding out of place. Therefore, there is no need for teflon wrist pin retainer discs or similar retainer parts as required by other compressors. Reliability is improved since there are less parts that can fail during operation. Further, the snap-in-place design of the sheath 50 provides a simple method of assembling the compressor 10.

During the suction stroke of piston 40, as depicted in FIG. 2, the piston 40 and sheath 50 separate at the seal 56 to allow low pressure gas to flow from passages 60*a*, 60*b*, through the sheath 50 at slit openings 53*a*, 53*b*, through the low pressure chambers 49*a*, 49*b*, and into the compression chamber 70. Although not required, it is preferred that slit openings 53*a*, 53*b* remain in fluid communication with passages 60*a*, 60*b* throughout the entire reciprocation range of the piston 40. To reduce the likelihood that low pressure gas will leak from around the slit openings 53*a*, 53*b*, between the fingers 59, and into that area of the bore 12 containing the con rod 42, it is preferable to not position any of the fingers 59 in the immediate vicinity of the slit openings 53*a*, 53*b*.

A discharge valve 80 establishes contact with the block 20 (closed position) to prevent low pressure gas from escaping the compression chamber 70. FIG. 1 illustrates the discharge valve 80 in the closed position. The discharge valve 80 is biased in a direction toward the block 20 by a helical coil spring 86 in compression between the head 30 and discharge valve 80. Thus, the discharge valve 80 is held in the closed position when not forced to its open position, as shown in FIG. 2, during the compression stroke. Contact between the discharge valve 80 and block 20 is preferably established between a beveled surface 100 at the top of the bore 12 and the outer edge 88 of the discharge valve 80, providing a continuous seal when the valve's outer edge 88 is in contact with the bore's beveled surface 100.

During the compression stroke, (FIG. 2) the piston 40 and sheath 50 establish contact at the seal 56 to form a continuous surface area comprised of the piston upper surface 44 and sheath upper surface 52. At this point of compressor operation, the low pressure gas chambers 49*a*, 49*b* are isolated from the compression chamber 70. As the piston 40 moves toward the head 30 during the compression stroke, gas within the compression chamber 70 is compressed against the bottom surface 82 of the closed discharge valve 80 so that the pressure of the gas within the compression chamber 70 increases. When the compressed gas achieves sufficient pressure to overcome the opposing force being applied to the discharge valve 80 by spring 86, the force of the compressed gas acting upon surface 82 moves the discharge valve 80 away from the block 20 into the open position (FIG. 2). A gap 102 is then created between the discharge valve's outer edge 88 and the bore's beveled surface 100 through which the pressurized gas passes into the discharge chamber 32 for thermodynamic circulation within the refrigeration system. At or near the apex of the compression stroke, the compression chamber 70 is evacuated of substantially all pressurized gas. When pressure within the compression chamber 70 is less than the force of spring 86, the discharge valve 80 returns to its closed position (FIG. 2).

Although the discharge valve 80 may take many forms, a preferred embodiment is illustrated in FIGS. 1, 2, and 11A–C. The discharge valve 80 is of substantially circular dimension and lenticular shape, and includes a bottom surface 82, a top surface 84, an outer beveled edge 88, a spring guide 81, and a plurality of stanchion guides 83. The valve 80 is preferably fabricated as a single part from a thermoplastic material similar to, or the same as the thermoplastic material used to fabricate the valving sheath 50. The bottom surface 82 is curved, or lenticular to conform to the surface curvature of the piston's upper surface 44 and the sheath's top surface 52, thereby providing substantially complete evacuation of pressurized gas from within the compression chamber 70 at or near the apex of the compression stroke. The lenticular, curved shapes of these compressor elements also function to enhance the distribution of mechanical forces during compressor operation. This in turn enables the lenticular shaped elements, particularly the sheath 50 and discharge valve 80, to be fabricated with thinner cross-sections and less material than would otherwise be possible if the elements were flat. Thus, it will be appreciated that by curving the sheath 50 and discharge valve 80 in the manner shown and described, the overall weight of the compressor 10 is reduced and efficiency is increased.

Figure 4:
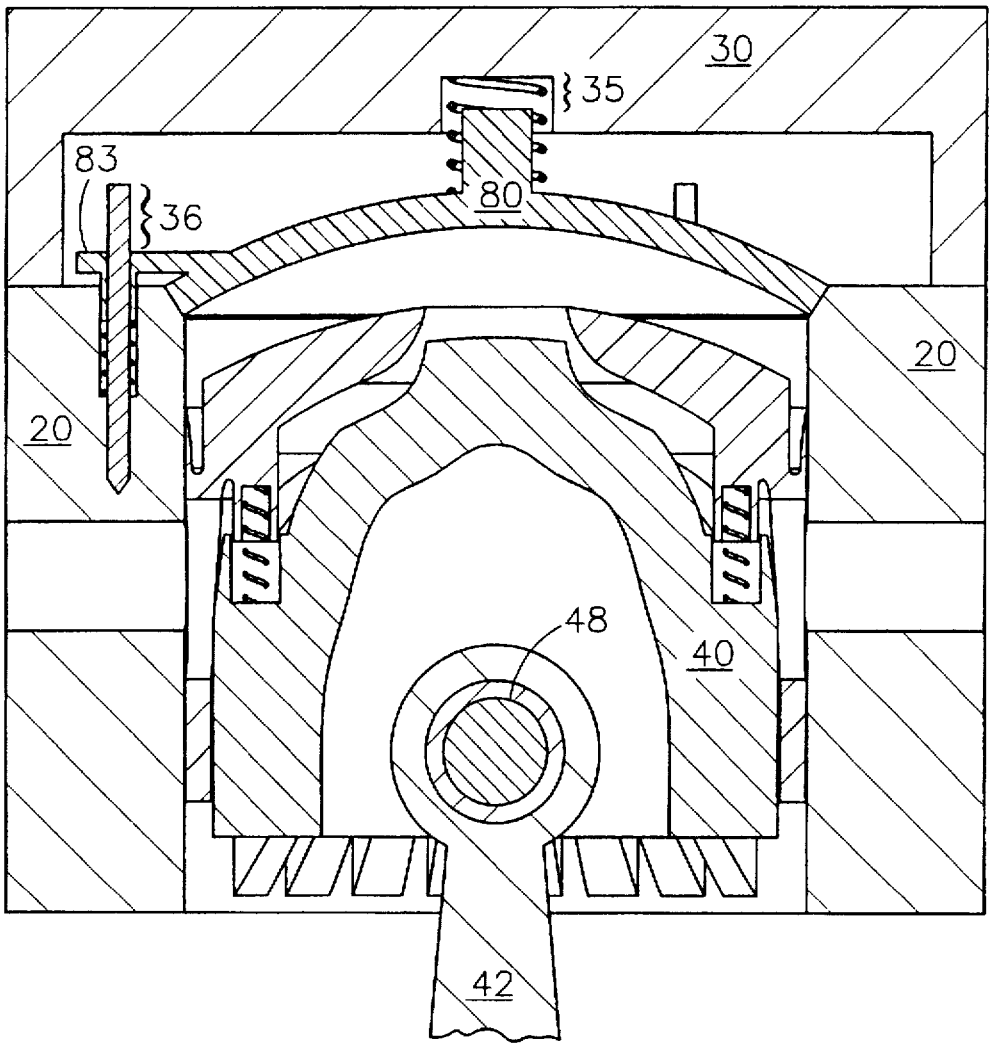
FIG. 4 is a sectional view of a discharge valve for a gas compressor, illustrating how the discharge valve is prevented from overtraveling stanchions which align the discharge valve with the piston bore.
Figure 5:
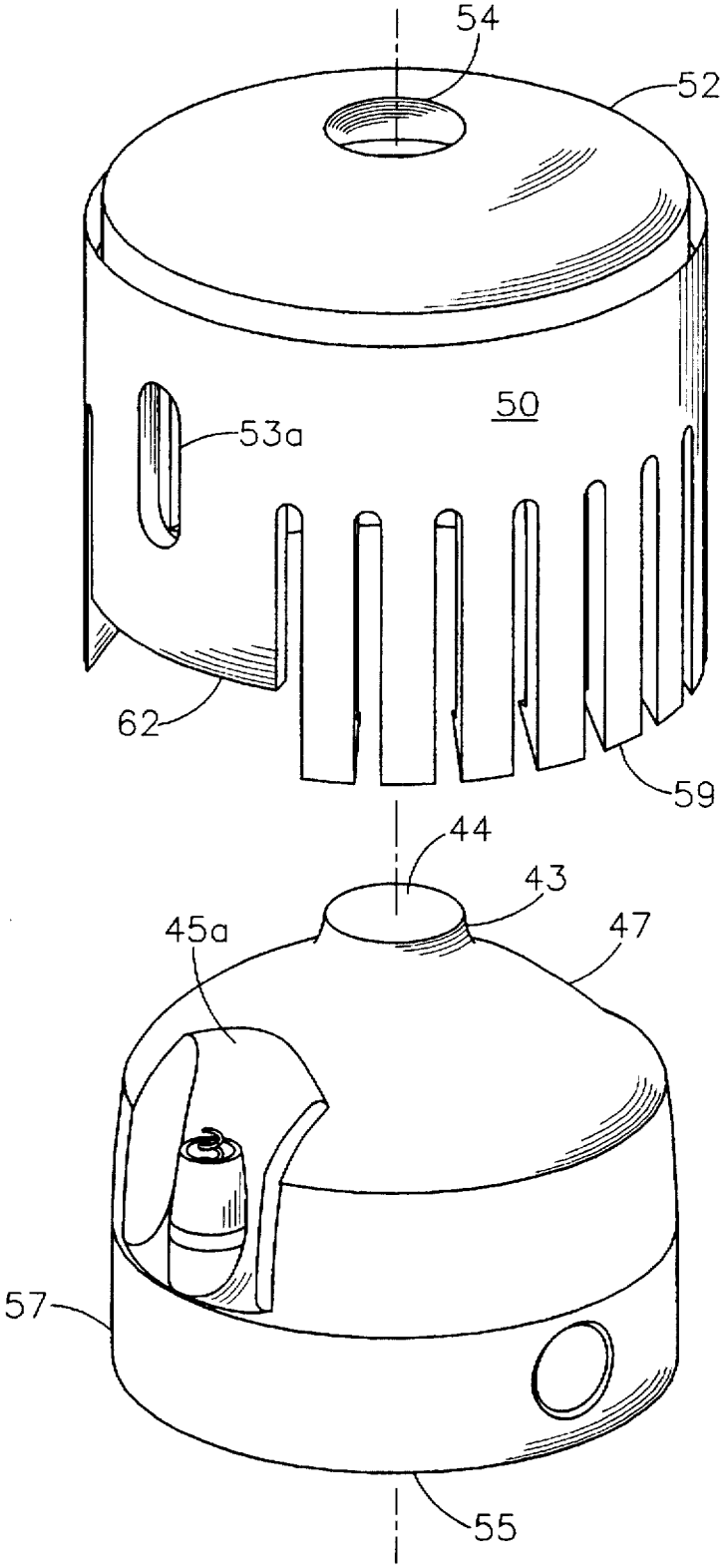
FIG. 5 is a breakaway view of the piston of FIG. 3 and valving sheath which snaps into place over the piston.
Figure 6:
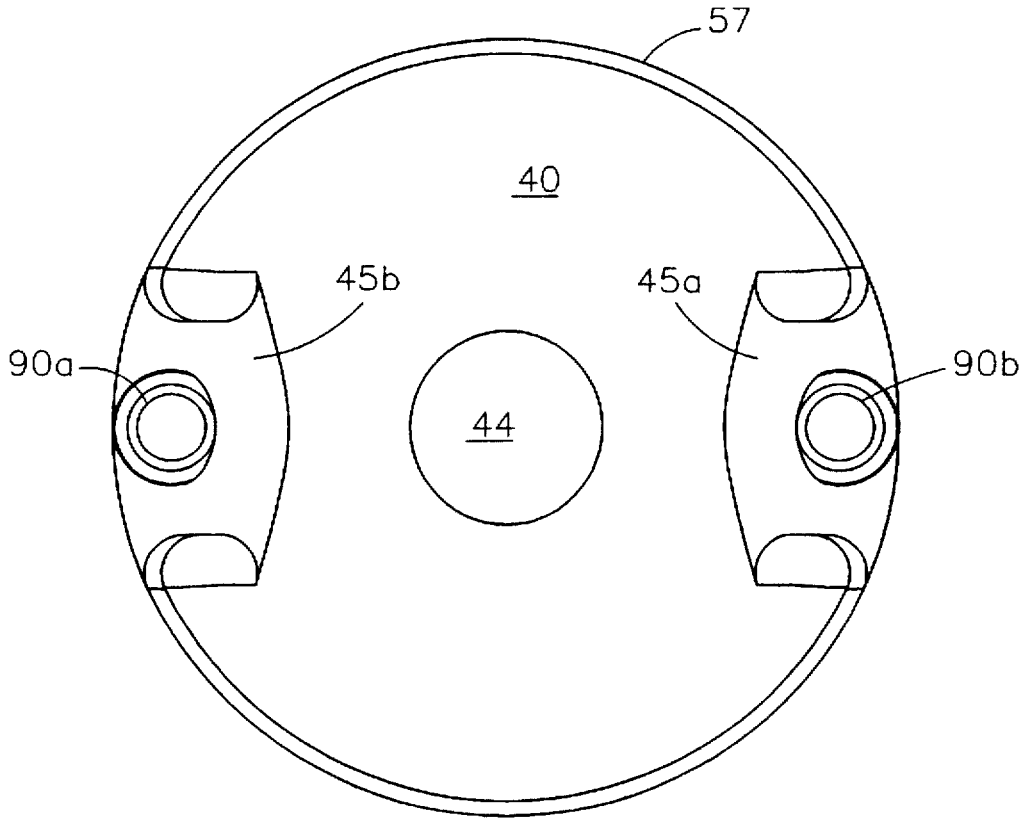
FIG. 6 is a top view of the piston of FIG. 3.
Figure 11A:
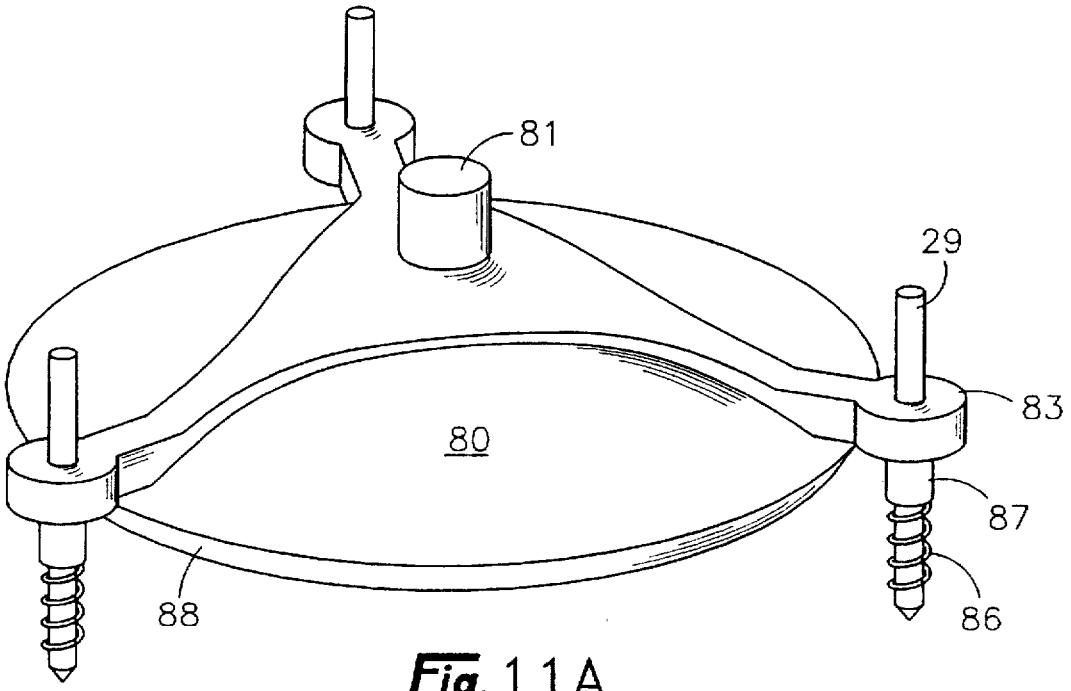
FIG. 11A is an isometric view of the discharge valve of FIG. 4.
Figure 11B:
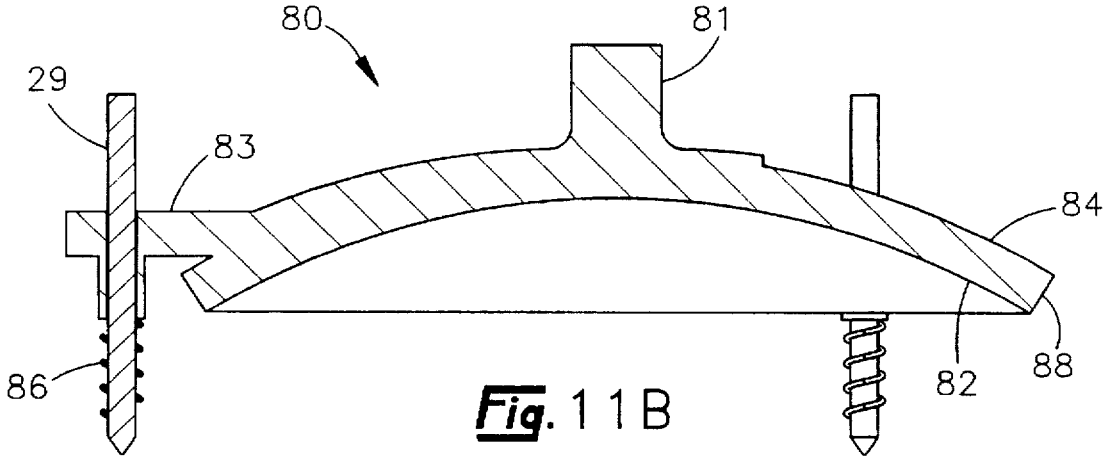
FIG. 11B is a cross-section view of the discharge valve.
Figure 11C:
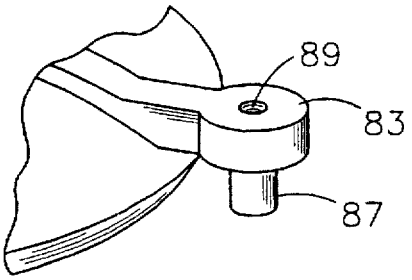
FIG. 11C is an isometric view of a guide formed in the discharge valve to guide the discharge valve along the stanchion of FIG. 4 during valving motion.

As FIG. 11A illustrates, three stanchion guides 83 are equally spaced 120° apart along the top surface 84. Each of the stanchion guides 83 extends beyond the outer edge 88 and engages a stanchion 29 seated within the block 20. Each stanchion 29 extends beyond its stanchion guide 83 into the discharge chamber 32 by a length 36 (FIG. 4). Preferably, each of the stanchions 29 are positioned 120° apart around the cylinder bore 12 and in alignment with the stanchion guides 83 so that when stanchion bores 89 in each of the guides 83 receive the stanchions 29, the discharge valve 80 is aligned and indexed to the beveled surface 100 at the top of the cylinder bore 12. Thus, as the discharge valve 80 cycles through its open and closed positions, the valve 80 maintains perfect alignment with the beveled surface 100 with little or no noisy wobbling or oscillatory settling.

Each of the stanchion guides 83 includes a slugging member 87 that extends into a slugging bore 21 (FIGS. 1 and 2) formed within the block 20. The slugging bore 21 is preferably of circular dimension having a perimeter greater than that of the slugging member 87. When fluids are present in the discharge chamber 32, fluid will enter and be contained within one or more of the slugging bores 21. Movement of the slugging member 87 becomes limited due to the presence of the incompressible fluid in the slugging bore 21, thus limiting the movement of the discharge valve 80 by preventing the valve 80 from closing until the fluid within the slugging bore(s) 21 is evaporated. In this manner, the discharge valve 80 avoids failure caused by intolerant forces generated when incompressible fluids are present in the discharge chamber 32.

As previously described with regard to dampers 90*a*, 90*b*, the relative dimensions of slugging member 87 and slugging bore 21 can be varied to regulate the amount of damping when fluids are present. Damping can also be controlled by forming a channel in block 20 which interconnects bore 21 with the discharge chamber 32.

The spring guide 81 serves a dual function. First, the spring guide 81 assists in holding the spring 86 in place within a spring pocket 34 formed in the head 30. Second, it functions to limit the extent to which the discharge valve 80 may be opened by limiting the maximum opening distance of the discharge valve 80 (indicated generally at 35 in FIG. 4) to less than the length 36 of each stanchion 29 that protrudes beyond the stanchion guide 83. By limiting the travel distance of the discharge valve 80 in such a way, the stanchion guides 83 are prevented from traveling beyond the ends of the stanchions 29 and causing the discharge valve 80 to jam or otherwise malfunction.

Many different types and positions of springs are available to either complement or replace the function provided by helical coil spring 86. For example, in addition to, or in lieu of compressive helical coil spring 86, one or more tensile helical coil springs may be disposed within the slugging bores 21 and connected in tension between the block 20 and stanchion guides 83 to bias the discharge valve 80 toward the beveled surface 100. Alternatively, all helical coil springs 86, as well as the stanchions 29 and stanchion guides 83, may be eliminated and one or more leaf springs (not shown) interconnected between the discharge valve 80 and block 20 or head 30 to bias the discharge valve 80 toward the beveled surface 100 in its closed position.

To prevent leakage of gas from the compression chamber 70, particularly along a potential leak path between the bore wall 22 and sheath outer surface 52, the compression chamber 70 should be sealed. In a preferred embodiment, gas is prevented from escaping the compression chamber 70 along this potential leak path by forming a circumferential lip seal 24 in the sheath 50 as shown in FIGS. 1, 2, 7, and 10. As illustrated in the sectional view of FIG. 8, the tapered lip seal 24 extends from a base 26 and terminates in a tip 28. Because the circumference of the sheath 50 at the tip 28 is greater than the circumference of the piston bore wall 22, the tip 28 is biased toward the bore wall 22 so that contact between the tip 28 and bore wall 22 is constantly maintained through the reciprocation range of the piston 40.

During the compression stroke, pressurized gas within the compression chamber 70 applies pressure to the inner surface 27 of the lip seal 24 which forces the tip 28 tightly against the bore wall 22, creating a continuous seal around the perimeter of the bore wall 22 that moves with the sheath 50 during its travel toward the discharge valve 80. During the suction stroke, the tip 28 remains in contact with the bore wall 22 as the sheath 40 moves away from the discharge valve 80. Because the sheath 50 is comprised of a thermoplastic material, and further due to the smoothness of the bore wall 22, minimal friction is created between the tip 28 and bore wall 22 during compressor operation. Thus, the lip seal 24 minimizes drag during the suction and compression strokes and enhances the efficiency of compressor operation. Additionally, because the lip seal 24 is fabricated from a thermoplastic material it provides a high degree of compliance and sealing with the piston bore wall 22. The employment of a lip seal 24 as shown to seal the compression chamber 70 also reduces the number of compressor parts since the lip seal 24 can be molded as an integral portion of sheath 50. Alternatively, other types of seals may be used.

Figure 10:
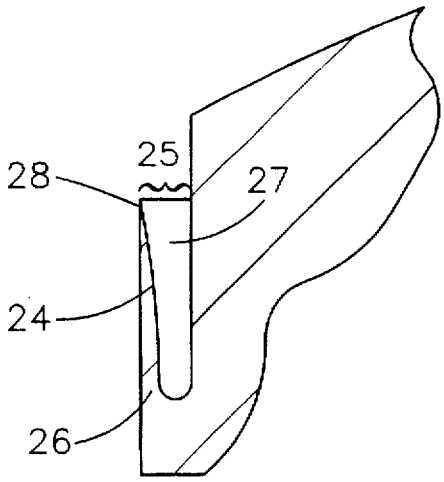
FIG. 10 is a sectional view of a lip seal formed in the sheath to prevent pressurized gas from escaping between the sheath and piston bore wall.

With reference to FIGS. 9 and 10, a gap 25 is created between the lip seal 24 and sheath outer surface 52. Although small in relation to the total volume of the compression chamber 70, this gap 25 will contain an amount of unevacuated gas at the apex of the compression stroke. Therefore, it is preferred that gap 25 be of minimal dimension in order to minimize the volume of gas occupying the gap 25 and maximize evacuation of compressed gas within the compression chamber 70.

It is contemplated, and will be apparent to those skilled in the art from the foregoing specification, drawings, and examples that modifications and/or changes may be made in the embodiments of the invention. Accordingly, it is expressly intended that the foregoing are illustrative of preferred embodiments only, not limiting thereto, and that the true spirit and scope of the present invention be determined by reference to the appended claims.

What is claimed is:

1. A gas compressor comprising:

a cylinder block having a piston bore formed therein, said piston bore being defined by a bore wall having a bore opening;

a cylinder block head connected to the cylinder block;

a piston having a piston top, a piston bottom, a piston perimeter, and a piston length defined by the distance between the top and bottom, said piston mounted for reciprocation within said piston bore along a piston axis of reciprocation, the reciprocation of the piston including a suction stroke of the piston and a compression stroke of the piston;

wherein each of said strokes defines movement of said piston over a piston stroke distance;

a valving sheath having a sheath top disposed over the piston top and a sheath body intermediate said piston and said bore wall, said sheath having:

an outer surface defining an outer sheath perimeter;

an inner surface defining an inner sheath perimeter greater than said piston perimeter and less than said outer sheath perimeter, said inner surface including a sheath seat for engaging the piston top;

a top opening formed in the sheath top; and one or more body openings formed in said sheath body;

said sheath positioned in said piston bore so that said inner sheath perimeter is adjacent said piston perimeter and said outer sheath perimeter is adjacent said bore wall, said inner sheath perimeter and said piston perimeter defining a sheath chamber therebetween, said sheath being mounted for reciprocation along the piston axis of reciprocation to provide movement of the sheath over a sheath stroke distance;

a discharge valve mounted intermediate said cylinder block head and said sheath top and having a valve bottom and a valve top, said valve bottom positioned adjacent the sheath top, defining a compression chamber between the valve bottom and the sheath top and further defining a discharge chamber between the valve top and the cylinder block head;

means for sealing the compression chamber to prevent compressed gas from escaping the compression chamber;

means for isolating the discharge chamber from the compression chamber during at least a portion of the suction stroke of the piston; and an inlet in communication with said one or more body openings in the sheath body for inputting gas in the compression chamber by way of the sheath chamber during the suction stroke of the piston.

2. A compressor in accordance with claim 1, wherein said sheath further comprises a sheath bottom and a sheath length defined by the distance between the sheath top and the sheath bottom, said sheath length being greater than said piston length.

3. A compressor in accordance with claim 2, wherein said sheath bottom includes means for retaining said inner sheath perimeter adjacent to said piston perimeter.

4. A compressor in accordance with claim 3, wherein said means for retaining includes one or more resilient fingers formed in said sheath, said one or more fingers functioning to retain adjacency of the inner sheath perimeter and piston perimeter when the sheath valve and piston are mounted in said piston bore, said one or more fingers functioning to limit the sheath stroke distance to less than the piston stroke distance, said one or more fingers allowing separation of the sheath from the piston when the sheath and piston are removed from the piston bore.

5. A compressor in accordance with claim 1, wherein said means for isolating includes:

a discharge valve seat formed in the discharge valve;

a seating surface formed in said cylinder block adjacent said bore opening; and means for resiliently urging said discharge valve toward said piston bore so that said discharge valve seat engages said seating surface when the force applied to the bottom of the discharge valve by compressed gas in the compression chamber is less than the force being applied by said means for resiliently urging to the discharge valve.

6. A compressor in accordance with claim 5, wherein said means for resiliently urging includes a helical coil spring disposed between said discharge valve and said cylinder block.

7. A compressor in accordance with claim 5, wherein said means for resiliently urging includes a leaf spring disposed between said discharge valve and said cylinder block.

8. A compressor in accordance with claim 1, further comprising means for movably connecting the discharge valve to the cylinder block.

9. A compressor in accordance with claim 8, wherein said means for movably connecting includes a plurality of guides, said cylinder block further including a plurality of stanchion bores disposed in said cylinder block adjacent said piston bore, each of said stanchion bores including:

a stanchion bore depth;

a stanchion bore perimeter; and a stanchion mounted in the stanchion bore substantially parallel to the piston axis of reciprocation, each stanchion having a stanchion length greater than the stanchion bore depth so that at least a portion of each stanchion protrudes from the cylinder block to define a plurality of stanchion protrusions having a stanchion protrusion length;

wherein each of said guides includes means for movably securing said discharge valve to a stanchion protrusion to provide aligned engagement of said discharge valve seat with said seating surface.

10. A compressor in accordance with claim 9, said discharge valve including means for limiting movement of the discharge valve to less than the stanchion protrusion length.

11. A compressor in accordance with claim 10, wherein said means for limiting includes a protruding member formed in the top of the discharge valve, said protruding member positioned at a limit distance from the cylinder block head when said discharge valve seat engages said seating surface, said limit distance being less than said stanchion protrusion length.

12. A compressor in accordance with claim 9, wherein at least one of said plurality of stanchion bores includes means for controlling slugging of the compressor.

13. A compressor in accordance with claim 12, wherein said means for controlling slugging includes a slugging bore in axial alignment with a stanchion bore, said slugging bore having a slugging bore perimeter greater than said stanchion bore perimeter and providing containment of fluids, at least one of said guides including a slugging member extending from said guide into said slugging bore to limit movement of said discharge valve when fluids are contained in said slugging bore.

14. A compressor in accordance with, claim 13, further comprising at least one channel formed in said cylinder block interconnecting said slugging bore and said discharge valve.

15. A compressor in accordance with claim 13, wherein said means for resiliently urging includes:

a spring disposed in said slugging bore and interconnected between said slugging bore and said slugging member for resiliently urging said discharge valve seat toward said seating surface when the force applied to the bottom of the discharge valve by compressed gas in the compression chamber is less than the force being applied by said spring to the discharge valve.

16. A compressor in accordance with claim 1, wherein said means for sealing includes a lip seal formed in the outer surface of the sheath, said lip seal preventing compressed gas in the compression chamber from escaping along the bore wall at least during the compression stroke of the piston.

17. A compressor in accordance with claim 1, further comprising means for damping relative motion between the sheath and piston at least during startup of the compressor.

18. A compressor in accordance with claim 17, wherein said means for damping includes damping stanchion means formed in said sheath, damping stanchion receiver means formed in said piston for receiving said damping stanchion means, and a spring interconnecting said damping stanchion means and said damping stanchion receiver means.

19. A compressor in accordance with claim 1, wherein said inlet includes:

one or more gas passages formed through said cylinder block at a position remote to said discharge chamber and being in communication with said bore; and at least one gas inlet formed through said sheath to provide communication between at least one gas passage and said sheath chamber over at least a substantial portion of each piston stroke.

20. A compressor in accordance with claim 1, wherein said inlet includes one or more gas passages formed through said piston in communication with said sheath chamber.

21. A compressor in accordance with claim 1, wherein said sheath is comprised of a thermoplastic material.

22. A compressor in accordance with claim 1, wherein said discharge valve is comprised of a thermoplastic material.

23. A compressor in accordance with claim 1, wherein said piston top includes a protruding section in axial alignment with the piston axis of reciprocation, said protruding section terminated by an upper surface having a protrusion surface area, said top opening formed in the sheath top having a top opening area greater than said protrusion surface area for receiving at least a portion of said protruding section during reciprocation of the piston.

24. A compressor in accordance with claim 23, wherein said protruding section includes a curved protruding section, said sheath top and said discharge valve bottom being curved to conform to said protruding section at least during the compression stroke of the piston.

25. A compressor discharge valve assembly disposed between the cylinder block and cylinder block head of a gas compressor for regulating the release of compressed gas from a compression chamber disposed in a piston bore formed in the cylinder block to a discharge chamber formed in the cylinder block head, said discharge valve assembly comprising:

a seating surface formed in the cylinder block adjacent the piston bore;

a discharge valve mounted intermediate said cylinder block head and said compression chamber, said discharge valve having:

a bottom surface adjacent said compression chamber;

a top surface adjacent said discharge chamber; and a discharge valve seat conforming to said seating surface;

a plurality of guides connected to said top surface, a plurality of stanchion bores disposed in said cylinder block adjacent said piston bore, each of said stanchion bores including:

a stanchion bore depth;

a stanchion bore perimeter; and a stanchion mounted in the stanchion bore substantially parallel to the piston axis of reciprocation, each stanchion having a stanchion length greater than the stanchion bore depth so that at least a portion of each stanchion protrudes from the cylinder block to define a plurality of stanchion protrusions having a stanchion protrusion length;

wherein each of said guides comprises means for movably securing said discharge valve to a stanchion protrusion to provide aligned engagement of said discharge valve seat with said seating surface; and means for resiliently urging said discharge valve toward said piston bore so that said discharge valve seat engages said seating surface when the force applied to the bottom of the discharge valve by compressed gas in the compression chamber is less than the force being applied by said means for resiliently urging to the discharge valve.

26. A discharge valve assembly according to claim 25, wherein the bottom surface of said discharge valve is substantially lenticular.

27. A discharge valve assembly according to claim 25, further comprising means for limiting movement of the discharge valve to less than the stanchion protrusion length.

28. A discharge valve assembly according to claim 27, wherein said means for limiting comprises a protruding member formed in the top of the discharge valve, said protruding member positioned at a limit distance from the cylinder block head when said annular seating surface is in contact with said annular seat, said limit distance being less than said stanchion protrusion length.

29. A discharge valve assembly in accordance with claim 25, wherein at least one of said plurality of stanchion bores further comprises means for controlling slugging of the compressor.

30. A discharge valve assembly in accordance with claim 29, wherein said means for controlling slugging comprises at least one slugging bore formed in the cylinder block in axial alignment with a stanchion bore, said at least one slugging bore having a slugging bore perimeter greater than said stanchion bore perimeter and providing containment of fluids, at least one of said guides further comprising a slugging member extending from said guide into said slugging bore to limit movement of said discharge valve when fluids are contained in said slugging bore.

31. A discharge valve assembly in accordance with claim 30, wherein said means for resiliently urging comprises a spring disposed in said slugging bore and interconnected between said slugging bore and said slugging member for resiliently urging said discharge valve seat toward said seating surface when the force applied to the bottom of the discharge valve by compressed gas in the compression chamber is less than the force being applied by said spring to the discharge valve.

32. A discharge valve assembly in accordance with claim 25, wherein said means for resiliently urging comprises a spring disposed between said discharge valve and said cylinder block head.

33. A discharge valve assembly in accordance with claim 32, wherein said spring comprises a helical coil spring.

34. A discharge valve assembly in accordance with claim 32, wherein said spring comprises a leaf spring.

35. A discharge valve assembly in accordance with claim 25, wherein said discharge valve is comprised of a thermoplastic material.

36. A discharge valve assembly in accordance with claim 25, wherein the bottom surface of the discharge valve is curved.

37. A compressor valving sheath assembly disposed between the piston and piston bore wall of a gas compressor for regulating the input of gas from a gas passage to a compression chamber of the gas compressor, said piston having a piston top, a piston bottom, a piston perimeter, and a piston length defined by the distance between the top and bottom, said piston mounted for reciprocation within said piston bore along a piston axis of reciprocation, said reciprocation including a suction stroke of the piston and a compression stroke of the piston, each of said strokes defining movement of said piston over a piston stroke distance, said sheath assembly comprising:

a valving sheath having:

a sheath top disposed over the piston top;

a sheath body intermediate said piston and said bore wall;

an outer surface defining an outer sheath perimeter;

an inner surface defining an inner sheath perimeter greater than said piston perimeter and less than said outer perimeter, said inner surface including a sheath seat for engaging the piston top;

a top opening formed in the sheath top; and one or more body openings formed in said sheath body;

said sheath positioned in said piston bore so that said inner sheath perimeter is adjacent said piston perimeter and said outer sheath perimeter is adjacent said bore wall, said inner sheath perimeter and said piston perimeter defining a sheath chamber therebetween, said sheath being mounted for reciprocation along the piston axis of reciprocation to provide movement of the sheath over a sheath stroke distance;

means for sealing the outer surface of the sheath against the bore wall to prevent compressed gas in the compression chamber from escaping along the bore wall; and an inlet in communication with said sheath chamber for inputting gas in the compression chamber by way of the sheath chamber during at least a portion of the suction stroke of the piston.

38. A sheath assembly in accordance with claim 37, wherein said sheath further comprises a sheath bottom and a sheath length defined by the distance between the sheath top and the sheath bottom, said sheath length being greater than said piston length.

39. A sheath assembly in accordance with claim 38, wherein said sheath bottom comprises means for retaining said inner sheath perimeter adjacent to said piston perimeter.

40. A sheath assembly in accordance with claim 39, wherein said means for retaining comprises one or more resilient fingers formed in said sheath, said one or more fingers functioning to retain adjacency of the inner sheath perimeter and piston perimeter when the sheath valve and piston are mounted in said piston bore, said one or more fingers functioning to limit relative movement between the sheath and piston to less than the piston stroke distance, said one or more fingers allowing separation of the sheath from the piston when the sheath and piston are removed from the piston bore.

41. A sheath assembly in accordance with claim 37, wherein said means for sealing comprises a lip seal formed in the outer surface of the sheath, said lip seal preventing compressed gas in the compression chamber from escaping along the bore wall at least during the compression stroke of the piston.

42. A sheath assembly in accordance with claim 37, further comprising means for damping relative motion between the sheath and piston at least during startup of the compressor.

43. A sheath assembly in accordance with claim 42, wherein said means for damping comprises damping stanchion means formed in said piston, damping stanchion receiver means formed in said sheath for receiving said damping stanchion means, and a spring interconnecting said damping stanchion means and said damping stanchion receiver means.

44. A sheath assembly in accordance with claim 37, wherein said sheath top is curved.

45. A gas compressor for compressing inlet gas received from an inlet, said compressor comprising:

a cylinder block having a piston bore formed therein, said piston bore being defined by a bore wall having a bore opening;

a cylinder block head connected to the cylinder block;

a piston having a piston top, a piston bottom, a piston perimeter, and a piston length defined by the distance between the top and bottom, said piston mounted for reciprocation within said piston bore along a piston axis of reciprocation, the reciprocation of the piston including a suction stroke of the piston and a compression stroke of the piston;

wherein each of said strokes defines movement of said piston over a piston stroke distance;

a valving sheath having a sheath top adjacent the piston top and a sheath body intermediate said piston and said bore wall, said sheath having:

an outer surface defining an outer sheath perimeter;

an inner surface defining an inner sheath perimeter greater than said piston perimeter and less than said outer sheath perimeter, said inner surface including a sheath seat for engaging the piston;

a top opening formed in the sheath top; and one or more body openings formed in said sheath body for receiving inlet gas;

said sheath positioned in said piston bore so that said inner sheath perimeter is adjacent said piston perimeter and said outer sheath perimeter is adjacent said bore wall, said inner sheath perimeter and said piston perimeter defining a sheath chamber therebetween, said sheath being mounted for reciprocation along the piston axis of reciprocation to provide movement of the sheath over a sheath stroke distance; and a discharge valve mounted intermediate said cylinder block head and said sheath top and having a valve bottom and a valve top, said valve bottom positioned adjacent the sheath top, defining a compression chamber between the valve bottom and the sheath top and further defining a discharge chamber between the valve top and the cylinder block head, said compression chamber containing compressed gas during the compression stroke of the piston and said discharge valve regulating the release of compressed gas from the compression chamber to the discharge chamber.

46. A compressor in accordance with claim 45, further comprising a seal for sealing the compression chamber to inhibit compressed gas from escaping the compression chamber.

47. A compressor in accordance with claim 46, wherein said seal includes a lip seal formed in the outer surface of the sheath, said lip seal inhibiting compressed gas in the compression chamber from escaping along the bore wall at least during the compression stroke of the piston.

48. A compressor in accordance with claim 45, wherein said sheath seat engages the piston to isolate the compression chamber from the sheath chamber during at least a portion of the compression stroke of the piston.

49. A compressor discharge valve assembly disposed between the cylinder block and cylinder block head of a gas compressor for regulating the release of compressed gas from a compression chamber disposed in a piston bore formed in the cylinder block to a discharge chamber formed in the cylinder block head, said discharge valve assembly comprising:

a seating surface formed in the cylinder block adjacent the piston bore;

a discharge valve mounted intermediate said cylinder block head and said compression chamber, said discharge valve having:

a bottom surface adjacent said compression chamber;

a top surface adjacent said discharge chamber; and a discharge valve seat conforming to said seating surface;

a plurality of guides arranged about a periphery of said discharge valve;

a plurality of stanchions integral with said cylinder block and projecting outwardly therefrom by a stanchion protrusion length, said plurality of stanchions being in aligned engagement with said plurality of guides to provide aligned engagement of said discharge valve seat with said seating surface; and means for urging said discharge valve seat toward said seating surface so that said discharge valve seat engages said seating surface when the force applied to the bottom of the discharge valve by compressed gas in the compression chamber is less than the force applied by said means for urging to the discharge valve.

50. A discharge valve assembly in accordance with claim 49, wherein said means for urging includes a spring.

51. A compressor valving sheath disposed between the piston and piston bore wall of a gas compressor for regulating the input of gas from a gas inlet to a compression chamber of the gas compressor, said piston having a piston top, a piston bottom, a piston perimeter, and a piston length defined by the distance between the top and bottom, said piston mounted for reciprocation within said piston bore along a piston axis of reciprocation, said reciprocation including a suction stroke of the piston and a compression stroke of the piston, each of said strokes defining movement of said piston over a piston stroke distance, said sheath comprising:

a sheath top adjacent the piston top;

a sheath body intermediate said piston and said bore wall;

an outer surface defining an outer sheath perimeter;

an inner surface defining an inner sheath perimeter greater than said piston perimeter and less than said outer sheath perimeter, said inner surface including a sheath seat for engaging the piston during at least a portion of the compression stroke of the piston;

a top opening formed in the sheath top; and one or more body openings formed in said sheath body for receiving gas from the gas inlet;

said sheath positioned in said piston bore so that said inner sheath perimeter is adjacent said piston perimeter and said outer sheath perimeter is adjacent said bore wall, said inner sheath perimeter and said piston perimeter defining a sheath chamber therebetween, said sheath being mounted for reciprocation along the piston axis of reciprocation to provide movement of the sheath over a sheath stroke distance.

52. A valving sheath in accordance with claim 51, further comprising a seal for sealing the compression chamber to inhibit compressed gas from escaping the compression chamber.

53. A valving sheath in accordance with claim 51, wherein said sheath includes a sheath bottom and a sheath length defined by the distance between the sheath top and the sheath bottom, said sheath bottom having a lip area projecting inwardly from the sheath inner surface toward the piston, said lip area contacting the bottom of the piston to limit relative movement of the sheath and piston as the piston is reciprocated.

* * * * *

UNITED STATES PATENT AND TRADEMARK OFFICE

CERTIFICATE OF CORRECTION

PATENT NO. : 5,775,886

DATED : July 7, 1998

INVENTOR(S) : Gerald L. Terwilliger

It is certified that error appears in the above-identified patent and that said Letters Patent is hereby corrected as shown below:

At Column 2, line 31, the words "will tend" should be replaced with the word --tends--.

At Column 3, line 26, after "from" and before "piston.", the word --the-- should be inserted.

At Column 4, line 58, the word "compression" should be replaced with the word --suction--.

At Column 4, line 61, the word "suction" should be replaced with the word --compression--.

At Column 6, line 40, the word "function" should be replaced with the word --functions--.

At Column 8, line 34, "2," should be replaced with --1,--.

At Column 9, line 17, "(FIG. 2)," should be replaced with -- (FIG.1), --.

Signed and Sealed this

Twenty-sixth Day of January, 1999

*Attest:*

*Attesting Officer*

*Acting Commissioner of Patents and Trademarks*